US011826001B2

(12) United States Patent
Boyer et al.

(10) Patent No.: US 11,826,001 B2
(45) Date of Patent: Nov. 28, 2023

(54) DISHWASHER WITH TUBULAR SPRAY ELEMENT INCLUDING ELONGATED METAL TUBE AND RETAINING TAB FOR MOUNTING SUPPORT MEMBER THERETO

(71) Applicant: Midea Group Co., Ltd., Foshan (CN)

(72) Inventors: Joel Boyer, Louisville, KY (US); Robert M. Digman, Goshen, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 17/671,872

(22) Filed: Feb. 15, 2022

(65) Prior Publication Data

US 2023/0255441 A1 Aug. 17, 2023

(51) Int. Cl.
*A47L 15/42* (2006.01)

(52) U.S. Cl.
CPC ..... *A47L 15/428* (2013.01)

(58) Field of Classification Search
CPC ..... A47L 15/0076; A47L 15/0078; A47L 15/0081; A47L 15/0092; A47L 15/16; A47L 15/18; A47L 15/20; A47L 15/22; A47L 15/23; A47L 15/4221; A47L 15/4278; A47L 15/428; A47L 15/4282
See application file for complete search history.

(56) References Cited

U.S. PATENT DOCUMENTS 2,808,063 A 10/1957 Abresch et al.
2,907,335 A 10/1959 Abresch
2,992,779 A 1/1960 James et al.
2,939,465 A 6/1960 Kesling
2,956,572 A 10/1960 Levit et al.
2,973,907 A 3/1961 Abresch et al.
2,980,120 A 4/1961 Jacobs
3,006,557 A 10/1961 Jacobs
3,026,046 A 3/1962 Wickham et al.
3,044,842 A 7/1962 Abresch et al.
3,051,183 A 8/1962 Jacobs
3,077,200 A 2/1963 Guth
3,082,779 A 3/1963 Jacobs
3,088,474 A 5/1963 Leslie
(Continued)

FOREIGN PATENT DOCUMENTS

CN 2094961 U 2/1992
CN 2395683 Y 9/2000
(Continued)

OTHER PUBLICATIONS

U.S. Patent and Trademark Office, Notice of Allowance issued in U.S. Appl. No. 16/795,484 dated Oct. 5, 2022.
(Continued)

*Primary Examiner* — David G Cormier
(74) *Attorney, Agent, or Firm* — Gray Ice Higdon

(57) ABSTRACT

A tubular spray element for a dishwasher is formed in part using an elongated metal tube joined with a molded polymer support member using one or more retaining tabs that are molded into the support member and that project within a sleeve in the support member to engage with cooperative mounting apertures in the elongated metal tube and thereby restrict relative movement between the elongated metal tube and the support member both about and along a longitudinal axis of the tubular spray element.

19 Claims, 6 Drawing Sheets

(56) References Cited

U.S. PATENT DOCUMENTS 3,101,730 A 8/1963 Harris et al.
3,115,306 A 12/1963 Graham
3,178,117 A 4/1965 Hanifan
3,192,935 A 7/1965 Hanifan
3,210,010 A 10/1965 Delapena
3,324,867 A 6/1967 Freese
3,348,775 A 10/1967 Flame
3,361,361 A 1/1968 Schutte
3,454,784 A 7/1969 Wantz et al.
3,538,927 A 11/1970 Harald
3,586,011 A 6/1971 Mazza
3,590,688 A 7/1971 Brannon
3,596,834 A 8/1971 Cushing
3,719,323 A 3/1973 Raiser
3,827,637 A 8/1974 Stephany et al.
3,854,665 A 12/1974 Rodgers
4,123,006 A 10/1978 Yukishita
4,175,575 A 11/1979 Cushing
4,226,490 A 10/1980 Jenkins et al.
4,301,822 A 11/1981 Dingler
4,398,562 A 8/1983 Saarem et al.
4,657,188 A 4/1987 Crane et al.
4,711,595 A * 12/1987 Magid ..... B25B 27/14 403/205
4,718,440 A 1/1988 Hawker et al.
4,732,323 A 3/1988 Jarvis et al.
4,822,241 A 4/1989 Jarvis et al.
5,098,020 A 3/1992 Cooper et al.
5,211,190 A 5/1993 Johnson et al.
5,226,454 A 7/1993 Cabalfin
5,341,827 A 8/1994 Kim
5,511,727 A 4/1996 Heren et al.
5,697,392 A 12/1997 Johnson et al.
5,725,002 A 3/1998 Payzant
5,752,533 A 5/1998 Edwards
5,759,647 A 6/1998 Kuroda et al.
5,927,616 A 7/1999 Grise et al.
6,053,185 A 4/2000 Beevers
6,431,188 B1 8/2002 Laszczewski, Jr. et al.
6,612,009 B1 9/2003 Laszczewski, Jr. et al.
6,694,990 B2 2/2004 Spanyer et al.
6,869,029 B2 3/2005 Ochoa et al.
6,955,742 B2 10/2005 McKay et al.
7,055,537 B2 6/2006 Elick et al.
7,182,562 B2 2/2007 Botosan et al.
7,210,315 B2 5/2007 Castelli et al.
7,252,246 B2 8/2007 Heren et al.
7,258,286 B1 8/2007 Wang et al.
7,293,435 B2 11/2007 Elexpuru et al.
7,445,013 B2 11/2008 VanderRoest et al.
7,464,718 B2 12/2008 McIntyre et al.
7,556,049 B2 7/2009 Oakes et al.
7,587,916 B2 9/2009 Rizzetto
7,594,513 B2 9/2009 VanderRoest et al.
7,607,325 B2 10/2009 Elexpuru et al.
7,650,765 B2 1/2010 Rizzetto
7,914,625 B2 3/2011 Bertsch et al.
7,935,194 B2 5/2011 Rolek
8,136,537 B2 3/2012 Cerrano et al.
8,161,995 B2 4/2012 Armstrong et al.
8,191,560 B2 6/2012 Mallory et al.
8,443,765 B2 5/2013 Hollis
8,696,827 B2 4/2014 Ashrafzadeh et al.
8,778,094 B2 7/2014 Blanchard et al.
8,858,729 B2 10/2014 Buddharaju et al.
8,900,375 B2 12/2014 Gnadinger et al.
8,915,257 B2 12/2014 Büsing et al.
8,932,411 B2 1/2015 Beaudet et al.
8,978,674 B2 3/2015 Büsing
8,985,128 B2 3/2015 Pyo et al.
9,121,217 B1 9/2015 Hoffberg
9,170,584 B2 10/2015 Lum et al.
9,199,286 B2 12/2015 Jendrichowski et al.
9,204,780 B2 12/2015 Francisco et al.
9,220,393 B2 12/2015 Becker et al.
9,241,604 B2 1/2016 Dries
9,259,137 B2 2/2016 Boyer et al.
9,265,400 B2 2/2016 Bigott
9,307,888 B2 4/2016 Baldwin et al.
9,326,657 B2 5/2016 Thiyagarajan
9,480,389 B2 11/2016 Haft et al.
9,492,055 B2 11/2016 Feddema
9,532,700 B2 1/2017 Welch
9,635,994 B2 5/2017 Boyer et al.
9,655,496 B2 5/2017 Baldwin et al.
9,915,356 B2 3/2018 Chang et al.
9,958,073 B2 5/2018 Yang
10,524,634 B2 1/2020 Digman
10,531,781 B2 1/2020 Digman et al.
10,631,708 B2 4/2020 Digman et al.
10,765,291 B2 9/2020 Digman et al.
2005/0011544 A1 1/2005 Rosenbauer et al.
2005/0139240 A1 6/2005 Bong et al.
2005/0241680 A1 11/2005 Noh
2005/0241681 A1 11/2005 Hwang
2006/0090778 A1 5/2006 Oakes et al.
2006/0278258 A1 12/2006 Kara et al.
2007/0215187 A1 9/2007 Koch et al.
2008/0163904 A1 7/2008 Hwang
2008/0271765 A1 11/2008 Burrows
2008/0276975 A1 11/2008 Disch
2009/0071508 A1 3/2009 Sundaram et al.
2009/0090400 A1 4/2009 Burrows et al.
2009/0145468 A1 6/2009 Chericoni
2010/0043826 A1 2/2010 Bertsch et al.
2011/0186085 A1 8/2011 Chen et al.
2012/0060875 A1 3/2012 Fauth et al.
2012/0175431 A1 7/2012 Althammer et al.
2012/0291827 A1 11/2012 Buddharaju et al.
2013/0000762 A1 1/2013 Buddharaju et al.
2013/0068265 A1 3/2013 Gnadinger et al.
2013/0137621 A1 5/2013 Kessler et al.
2013/0319483 A1 12/2013 Welch
2014/0059880 A1 3/2014 Bertsch et al.
2014/0069470 A1 3/2014 Baldwin et al.
2014/0345654 A1 11/2014 Cho et al.
2014/0373876 A1 12/2014 Feddema
2015/0007861 A1 1/2015 Azmi et al.
2015/0266065 A1 9/2015 Savoia
2016/0058264 A1 3/2016 Thiyagarajan
2016/0198928 A1 7/2016 Xu et al.
2017/0135548 A1 5/2017 Swarnkar
2017/0181599 A1 6/2017 Choi et al.
2017/0224190 A1 8/2017 Sakthivel et al.
2017/0265707 A1 9/2017 Roderick et al.
2017/0273535 A1 9/2017 Roderick et al.
2017/0354308 A1 12/2017 Choi et al.
2018/0035863 A1 2/2018 Liu et al.
2018/0084967 A1 3/2018 Ross et al.
2018/0110397 A1 4/2018 Kim et al.
2018/0132692 A1 5/2018 Dries
2018/0168425 A1 6/2018 Wilson et al.
2018/0192851 A1 7/2018 Gursoy et al.
2018/0220870 A1 8/2018 Beshears, Jr. et al.
2018/0333037 A1 11/2018 Roderick et al.
2018/0360293 A1 12/2018 Boyer
2019/0059688 A1 2/2019 Woo et al.
2019/0099054 A1 4/2019 Digman et al.
2019/0099056 A1 4/2019 Digman
2019/0191959 A1 6/2019 Brightbill et al.
2019/0290095 A1 9/2019 Wahlberg et al.
2019/0307308 A1 10/2019 Haegermarck
2020/0077868 A1 3/2020 Digman et al.
2020/0085277 A1 3/2020 Digman et al.
2020/0085279 A1 3/2020 Digman et al.
2020/0107696 A1 4/2020 Digman et al.
2020/0288940 A1 9/2020 Fawaz et al.
2021/0251462 A1 8/2021 Boyer
2021/0267430 A1 9/2021 Digman et al.

FOREIGN PATENT DOCUMENTS

CN 1879547 A 12/2006
CN 101049224 A 10/2007

(56) References Cited

FOREIGN PATENT DOCUMENTS

| | | | |
|---|---|---|---|
| CN | 101134198 | A | 3/2008 |
| CN | 201067392 | Y | 6/2008 |
| CN | 101795613 | A | 8/2010 |
| CN | 102307508 | A | 1/2012 |
| CN | 102370450 | A | 3/2012 |
| CN | 102512128 | A | 6/2012 |
| CN | 102940476 | A | 2/2013 |
| CN | 203447254 | U | 2/2014 |
| CN | 203749364 | U | 8/2014 |
| CN | 203763025 | U | 8/2014 |
| CN | 104433985 | A | 3/2015 |
| CN | 104523208 | A | 4/2015 |
| CN | 104757921 | A | 7/2015 |
| CN | 104840165 | A | 8/2015 |
| CN | 204671085 | U | 9/2015 |
| CN | 105147218 | A | 12/2015 |
| CN | 105147220 | A | 12/2015 |
| CN | 105231971 | A | 1/2016 |
| CN | 205094364 | U | 3/2016 |
| CN | 106224508 | A | 12/2016 |
| CN | 106574786 | A | 4/2017 |
| CN | 105286746 | B | 2/2018 |
| CN | 108697298 | A | 10/2018 |
| CN | 109124522 | A | 1/2019 |
| CN | 109236874 | A | 1/2019 |
| CN | 109538865 | A | 3/2019 |
| CN | 110578787 | B | 1/2021 |
| DE | 3537184 | A1 | 4/1987 |
| DE | 20113227 | U1 | 10/2001 |
| DE | 10121083 | A1 | 10/2002 |
| DE | 10300501 | A1 | 7/2004 |
| DE | 202004013786 | U1 | 12/2004 |
| DE | 102008011743 | A1 | 9/2009 |
| DE | 202014010365 | U1 | 5/2015 |
| EP | 0368096 | A2 | 5/1990 |
| EP | 0559466 | A1 | 9/1993 |
| EP | 0679365 | A1 | 11/1995 |
| EP | 0764421 | A1 | 3/1997 |
| EP | 0786231 | A2 | 7/1997 |
| EP | 0826427 | A2 | 3/1998 |
| EP | 0864291 | A1 | 9/1998 |
| EP | 1132038 | A2 | 9/2001 |
| EP | 1136030 | A1 | 9/2001 |
| EP | 1238622 | A2 | 9/2002 |
| EP | 1252856 | A2 | 10/2002 |
| EP | 1632166 | A2 | 3/2006 |
| EP | 1758494 | A1 | 3/2007 |
| EP | 2452759 | A1 | 5/2012 |
| EP | 2636786 | A1 | 9/2013 |
| EP | 2059160 | B1 | 3/2015 |
| EP | 3222191 | A1 | 9/2017 |
| FR | 1473796 | A | 3/1967 |
| GB | 572623 | A | 10/1945 |
| GB | 2244209 | A | 11/1991 |
| JP | 2003339607 | A | 12/2003 |
| JP | 2014121353 | A | 7/2014 |
| KR | 100786069 | B1 | 12/2007 |
| KR | 200442414 | Y1 | 11/2008 |
| KR | 101173691 | B1 | 8/2012 |
| KR | 200464747 | Y1 | 1/2013 |
| WO | 2009008827 | A1 | 1/2009 |
| WO | 2016008699 | A1 | 1/2016 |
| WO | 2017022974 | A1 | 2/2017 |
| WO | 2018053635 | A1 | 3/2018 |
| WO | 2018107833 | A1 | 6/2018 |
| WO | 2018107834 | A1 | 6/2018 |
| WO | 2018107835 | A1 | 6/2018 |
| WO | 2020052211 | A1 | 3/2020 |
| WO | 2020052215 | A1 | 3/2020 |

OTHER PUBLICATIONS

U.S. Patent and Trademark Office, Office Action issued in U.S. Appl. No. 16/795,484 dated May 18, 2022.

Electrolux Home Products, Inc. "Dishwasher Use & Care Guide 1500 Series with Fully Electronic Control" 2003.

Scribd, Sears Kenmore Elite 2013 Stainless Steel Tall Tub Dishwasher Service Manual, www.scribd.com, Retrieved on Dec. 5, 2018.

EverySpec, Federal Specification: Dishwashing Machines, Single Tank and Double Tank, Commercial, www.everyspec.com, Oct. 17, 1983.

Encyclo, "Keyed Connector—Definition—Encyclo", https://www.encyclo.co.uk/meaning-of-Keyed_connectors, 2020.

International Search Report and Written Opinion issued in Application No. PCT/CN2020/108004 dated Oct. 26, 2020.

Boyan Manufacturing Solutions, Custom Plastic Helical Gears, Retrieved on Jul. 1, 2020.

Gardiner, Ginger, Injection-Forming for High-Performance, Unitized Thermoplastic Structures, CompositesWorld, Jul. 30, 2019.

International Search Report and Written Opinion issued in Application No. PCT/CN2021/110530, dated Oct. 27, 2021, 10 pages.

* cited by examiner

DISHWASHER WITH TUBULAR SPRAY ELEMENT INCLUDING ELONGATED METAL TUBE AND RETAINING TAB FOR MOUNTING SUPPORT MEMBER THERETO

BACKGROUND

Dishwashers are used in many single-family and multi-family residential applications to clean dishes, silverware, cutlery, cups, glasses, pots, pans, etc. (collectively referred to herein as "utensils"). Many dishwashers rely primarily on rotatable spray arms that are disposed at the bottom and/or top of a tub and/or are mounted to a rack that holds utensils. A spray arm is coupled to a source of wash fluid and includes multiple apertures for spraying wash fluid onto utensils, and generally rotates about a central hub such that each aperture follows a circular path throughout the rotation of the spray arm. The apertures may also be angled such that force of the wash fluid exiting the spray arm causes the spray arm to rotate about the central hub.

While traditional spray arm systems are simple and mostly effective, they have the shortcoming that they must spread the wash fluid over all areas equally to achieve a satisfactory result. In doing so, resources such as time, energy and water are generally wasted because wash fluid cannot be focused precisely where it is needed. Moreover, because spray arms follow a generally circular path, the corners of a tub may not be covered as thoroughly, leading to lower cleaning performance for utensils located in the corners of a rack. In addition, in some instances the spray jets of a spray arm may be directed to the sides of a wash tub during at least portions of the rotation, leading to unneeded noise during a wash cycle.

A different approach to traditional spray arm systems utilizes one or more tubular spray elements to spray utensils within a dishwasher. A tubular spray element is a type of rotatable conduit that both conveys wash fluid along its length and ejects the wash fluid through various apertures disposed on an exterior surface thereof. A tubular spray element is generally formed of an elongated body and rotates about a longitudinal axis thereof, either in a controllable or uncontrollable fashion, e.g., based upon an electric drive, a hydraulic drive, or as a result of rotational forces imparted by the ejection of wash fluid from the tubular spray element.

It has been found, however, that the manufacture of a tubular spray element can present challenges, particularly when it is desirable to incorporate a metal tube such as a stainless steel tube into the design.

SUMMARY

The herein-described embodiments address these and other problems associated with the art by providing a dishwasher and method for making and/or using the same utilizing a tubular spray element formed in part using an elongated metal tube joined with a molded polymer support member using one or more retaining tabs that are molded into the support member and that project within a sleeve in the support member to engage with cooperative mounting apertures in the elongated metal tube and thereby restrict relative movement between the elongated metal tube and the support member both about and along a longitudinal axis of the tubular spray element.

Therefore, consistent with one aspect of the invention, a dishwasher may include a wash tub, a fluid supply configured to supply a wash fluid, and a tubular spray element disposed within the wash tub and being rotatable about a longitudinal axis thereof. The tubular spray element includes a plurality of apertures in fluid communication with the fluid supply to direct wash fluid into the wash tub, and further includes an elongated metal tube including a supported end through which wash fluid is received from the fluid supply, a sidewall in which the plurality of apertures are disposed, and a mounting aperture disposed in the sidewall proximate the supported end of the elongated metal tube; a support member formed of a molded polymer material and including a sleeve configured to receive the supported end of the elongated metal tube; and a retaining tab molded into the support member and projecting substantially radially within the sleeve to engage with the mounting aperture of the elongated metal tube and thereby restrict relative movement between the elongated metal tube and the support member both about and along the longitudinal axis of the tubular spray element.

In some embodiments, the support member further includes a gear molded thereon. Also, in some embodiments, the gear includes a plurality of teeth projecting radially from the longitudinal axis of the tubular spray element. Further, in some embodiments, the sleeve is disposed within a tubular portion of the support member that projects axially from the gear along the longitudinal axis of the tubular spray element.

In some embodiments, the retaining tab is coupled to the support member through an integrally molded living hinge. In addition, in some embodiments, the retaining tab includes a bulbous head and the living hinge has a width that is less than that of the bulbous head. In some embodiments, the sleeve is disposed in a tubular portion of the support member that projects axially along the longitudinal axis of the tubular spray element, the retaining tab projects inwardly into the sleeve in a substantially radial direction relative to the longitudinal axis, and the retaining tab and at least a portion of the living hinge are separated from a sidewall of the tubular portion by a continuous slot formed in the sidewall of the tubular portion.

In addition, in some embodiments, the living hinge extends along and flexes within a plane that is substantially transverse to the longitudinal axis. Moreover, in some embodiments, the retaining tab trails the living hinge in a direction of rotation of the tubular spray element.

In some embodiments, the support member has an injection molding part line extending along the plane such that the retaining tab and the living hinge are substantially bisected by the injection molding part line. Moreover, in some embodiments, the retaining tab and the living hinge are formed using a single action during injection molding.

In some embodiments, the retaining tab includes opposing first and second sidewalls that engage with the mounting aperture when the retaining tab is received within the mounting aperture to restrict relative rotational movement between the elongated metal tube and the support member about the longitudinal axis. In addition, in some embodiments, the retaining tab further includes a third sidewall disposed intermediate the first and second sidewalls and configured to engage with the mounting aperture when the retaining tab is received within the mounting aperture to restrict relative movement between the elongated metal tube and the support member along the longitudinal axis. In some embodiments, the retaining tab further includes a fourth sidewall disposed intermediate the first and second sidewalls and opposing the third sidewall, the fourth sidewall configured to engage with the mounting aperture when the retaining tab is received within the mounting aperture to further restrict relative movement between the elongated metal tube and the support member along the longitudinal axis. Moreover, in some embodiments, the mounting aperture is substantially circular, and the first, second and third sidewalls of the retaining tab form at least a portion of a cylindrical surface having a diameter substantially matching that of the mounting aperture.

Also, in some embodiments, the retaining tab further includes an inclined ramp configured to engage with an edge of the elongated metal tube when inserting the elongated metal tube into the sleeve of the support member during assembly to flex the living hinge and thereby deflect the retaining tab until the retaining tab is aligned with the mounting aperture. In some embodiments, the inclined ramp faces a backside of the support member such that the elongated metal tube is inserted through the backside of the support member during assembly.

Consistent with another aspect of the invention, a dishwasher tubular spray element may include an elongated metal tube being rotatable about a longitudinal axis thereof and including a supported end through which wash fluid is received from a fluid supply, a plurality of apertures formed in a sidewall thereof and configured to direct wash fluid supplied through the supported end into the wash tub, and a mounting aperture disposed in the sidewall proximate the supported end of the elongated metal tube; a support member formed of a molded polymer material and including a sleeve configured to receive the supported end of the elongated metal tube; and a retaining tab molded into the support member and projecting substantially radially within the sleeve to engage with the mounting aperture of the elongated metal tube and thereby restrict relative movement between the elongated metal tube and the support member both about and along the longitudinal axis.

In addition, in some embodiments, the retaining tab is coupled to the support member through an integrally molded living hinge, the sleeve is disposed in a tubular portion of the support member that projects axially along the longitudinal axis of the tubular spray element, the retaining tab projects inwardly into the sleeve in a substantially radial direction relative to the longitudinal axis, the retaining tab and at least a portion of the living hinge are separated from a sidewall of the tubular portion by a continuous slot formed in the sidewall of the tubular portion, and the living hinge extends along and flexes within a plane that is substantially transverse to the longitudinal axis.

Also, in some embodiments, the support member has an injection molding part line extending along the plane such that the retaining tab and the living hinge are substantially bisected by the injection molding part line, and the retaining tab includes opposing first and second sidewalls that engage with the mounting aperture when the retaining tab is received within the mounting aperture to restrict relative rotational movement between the elongated metal tube and the support member about the longitudinal axis, a third sidewall disposed intermediate the first and second sidewalls and configured to engage with the mounting aperture when the retaining tab is received within the mounting aperture to restrict relative movement between the elongated metal tube and the support member along the longitudinal axis, and an inclined ramp configured to engage with an edge of the elongated metal tube when inserting the elongated metal tube into the sleeve of the support member during assembly to flex the living hinge and thereby deflect the retaining tab until the retaining tab is aligned with the mounting aperture.

Other embodiments may include various methods for making and/or using any of the aforementioned constructions.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
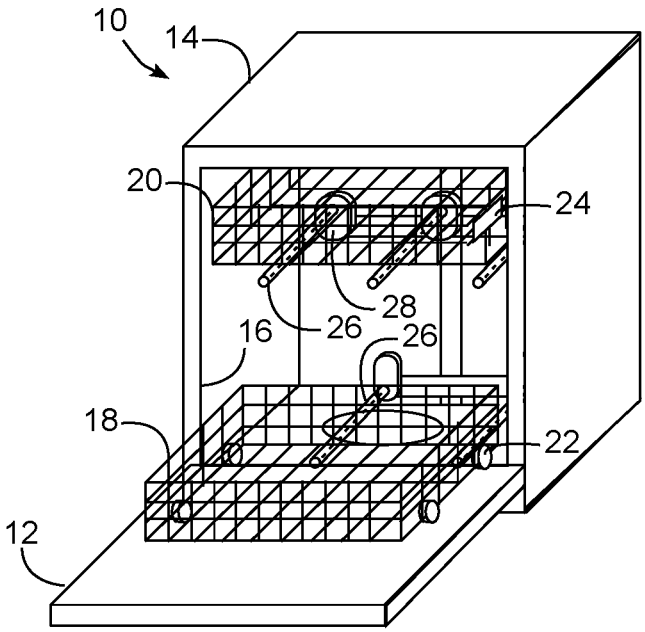
FIG. 1 is a perspective view of a dishwasher consistent with some embodiments of the invention.

In some embodiments consistent with the invention, a tubular spray element is formed in part using an elongated tube joined with a molded polymer support member using one or more retaining tabs that are molded into the support member and that project radially within a sleeve in the support member to engage with cooperative mounting apertures in the elongated metal tube and thereby restrict relative movement between the elongated metal tube and the support member both about and along a longitudinal axis of the tubular spray element.

A tubular spray element, in this regard, may be considered to be a type of rotatable conduit that includes a body capable of communicating a fluid such as water, a wash fluid including water, detergent and/or another treatment composition, or pressurized air, and that is capable of communicating the fluid to one or more apertures or nozzles to spray fluid onto utensils within a wash tub. A tubular spray element generally includes an elongated body, which may be generally cylindrical in some embodiments but may also have other cross-sectional profiles in other embodiments, and which has one or more apertures disposed on an exterior surface thereof and in fluid communication with a fluid supply, e.g., through one or more internal passageways defined therein. A tubular spray element also has a longitudinal axis generally defined along its longest dimension and about which the tubular spray element rotates. Further, when a tubular spray element is mounted on a rack and configured to selectively engage with a dock based upon the position of the rack, this longitudinal axis may also be considered to be an axis of insertion. A tubular spray element may also have a cross-sectional profile that varies along the longitudinal axis, so it will be appreciated that a tubular spray element need not have a circular cross-sectional profile along its length as is illustrated in a number embodiments herein. In addition, the one or more apertures on the exterior surface of a tubular spray element may be arranged into nozzles in some embodiments, and may be fixed or movable (e.g., rotating, oscillating, etc.) with respect to other apertures on the tubular spray element. Further, the exterior surface of a tubular spray element may be defined on multiple components of a tubular spray element, i.e., the exterior surface need not be formed by a single integral component.

In addition, in some embodiments a tubular spray element may be discretely directed by a tubular spray element drive to multiple rotational positions about the longitudinal axis to spray a fluid in predetermined directions into a wash tub of a dishwasher during a wash cycle. In some embodiments, the tubular spray element may be operably coupled to such a drive through a support arrangement that both rotates the tubular spray element and supplies fluid to the tubular spray element, as will become more apparent below. Further details regarding tubular spray elements may be found, for example, in U.S. Pat. No. 10,531,781 to Digman et al., which is assigned to the same assignee as that of the present application, and which is incorporated by reference herein. In other embodiments, however, a tubular spray element may rotate in a less controlled fashion, e.g., through the use of an electric drive, a hydraulic drive, or based upon a force generated in reaction to the ejection of wash fluid from the tubular spray element itself. In such instances, the rotational position of a tubular spray element may not be discretely controlled and/or known at any given time, although other aspects of the rotation or operation of the tubular spray element may still be controlled in some embodiments, e.g., the speed of rotation, whether rotation is enabled or disabled, and/or whether fluid flow is provided to the tubular spray element, etc.

Dishwasher

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers 22, while upper rack 20 may be supported on side rails 24, and each rack is movable between loading (extended) and washing (retracted) positions along a substantially horizontal direction. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle.

In addition, consistent with some embodiments of the invention, dishwasher 10 may include one or more tubular spray elements (TSEs) 26 to direct a wash fluid onto utensils disposed in racks 18, 20. As will become more apparent below, tubular spray elements 26 are rotatable about respective longitudinal axes and are discretely directable by one or more tubular spray element drives (not shown in FIG. 1) to control a direction at which fluid is sprayed by each of the tubular spray elements. In some embodiments, fluid may be dispensed solely through tubular spray elements, however the invention is not so limited. For example, in some embodiments various upper and/or lower rotating spray arms may also be provided to direct additional fluid onto utensils. Still other sprayers, including various combinations of wall-mounted sprayers, rack-mounted sprayers, oscillating sprayers, fixed sprayers, rotating sprayers, focused sprayers, etc., may also be combined with one or more tubular spray elements in some embodiments of the invention.

Some tubular spray elements 26 may be fixedly mounted to a wall or other structure in wash tub 16, e.g., as may be the case for tubular spray elements 26 disposed below or adjacent lower rack 18. For other tubular spray elements 26, e.g., rack-mounted tubular spray elements, the tubular spray elements may be removably coupled to a docking arrangement such as docking arrangement 28 mounted to the rear wall of wash tub 16 in FIG. 1.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers or dish sink dishwashers, e.g., a dishwasher integrated into a sink.

Figure 2:
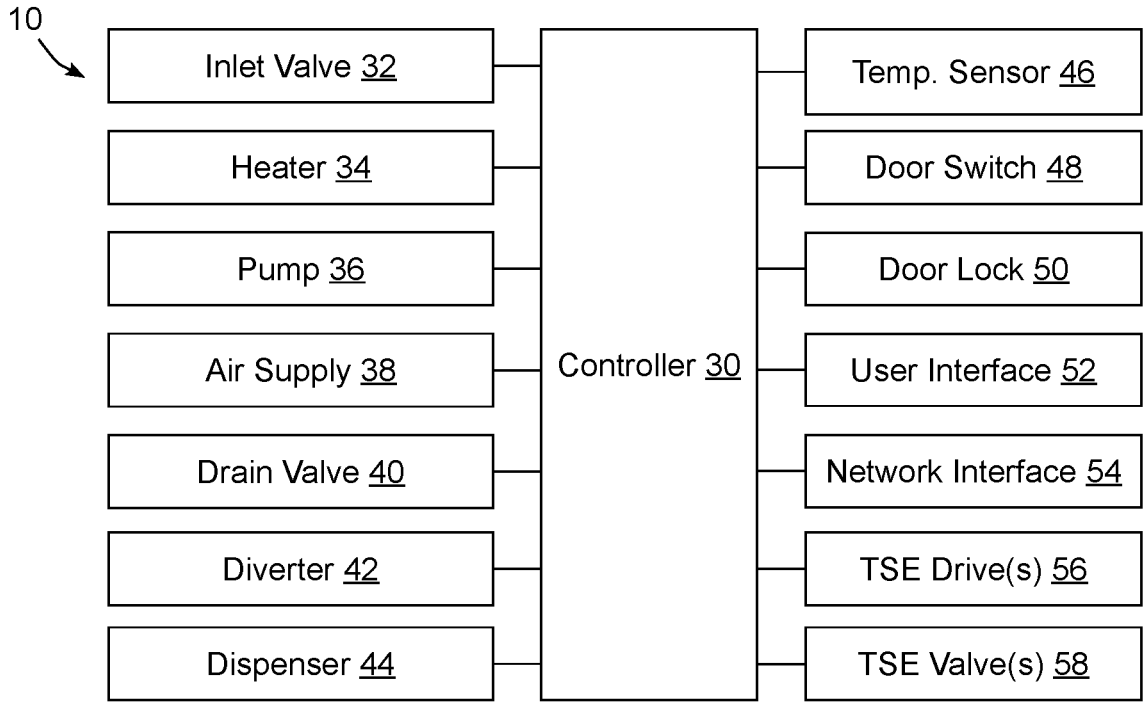
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, include one or more processors and a memory (not shown) within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components, including an inlet valve 32 that is coupled to a water source to introduce water into wash tub 16, which when combined with detergent, rinse agent and/or other additives, forms various wash fluids. Controller may also be coupled to a heater 34 that heats fluids, a pump 36 that recirculates wash fluid within the wash tub by pumping fluid to the wash arms and other spray devices in the dishwasher, an air supply 38 that provides a source of pressurized air for use in drying utensils in the dishwasher, a drain valve 40 that is coupled to a drain to direct fluids out of the dishwasher, and a diverter 42 that controls the routing of pumped fluid to different tubular spray elements, spray arms and/or other sprayers during a wash cycle. In some embodiments, a single pump 36 may be used, and drain valve 40 may be configured to direct pumped fluid either to a drain or to the diverter 42 such that pump 36 is used both to drain fluid from the dishwasher and to recirculate fluid throughout the dishwasher during a wash cycle. In other embodiments, separate pumps may be used for draining the dishwasher and recirculating fluid. Diverter 42 in some embodiments may be a passive diverter that automatically sequences between different outlets, while in some embodiments diverter 42 may be a powered diverter that is controllable to route fluid to specific outlets on demand. In still other embodiments, and as will be discussed in greater detail below, each tubular spray element may be separately controlled such that no separate diverter is used. Air supply 38 may be implemented as an air pump or fan in different embodiments, and may include a heater and/or other air conditioning device to control the temperature and/or humidity of the pressurized air output by the air supply.

In the illustrated embodiment, pump 36 and air supply 38 collectively implement a fluid supply for dishwasher 100, providing both a source of wash fluid and pressurized air for use respectively during wash and drying operations of a wash cycle. A wash fluid may be considered to be a fluid, generally a liquid, incorporating at least water, and in some instances, additional components such as detergent, rinse aid, and other additives. During a rinse operation, for example, the wash fluid may include only water. A wash fluid may also include steam in some instances. Pressurized air is generally used in drying operations, and may or may not be heated and/or dehumidified prior to spraying into a wash tub. It will be appreciated, however, that pressurized air may not be used for drying purposes in some embodiments, so air supply 38 may be omitted in some instances. Moreover, in some instances, tubular spray elements may be used solely for spraying wash fluid or spraying pressurized air, with other sprayers or spray arms used for other purposes, so the invention is not limited to the use of tubular spray elements for spraying both wash fluid and pressurized air.

Controller 30 may also be coupled to a dispenser 44 to trigger the dispensing of detergent and/or rinse agent into the wash tub at appropriate points during a wash cycle. Additional sensors and actuators may also be used in some embodiments, including a temperature sensor 46 to determine a wash fluid temperature, a door switch 48 to determine when door 12 is latched, and a door lock 50 to prevent the door from being opened during a wash cycle. Moreover, controller 30 may be coupled to a user interface 52 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 54, e.g., for interfacing with external devices via wired and/or wireless networks such as Ethernet, Bluetooth, NFC, cellular and other suitable networks. Additional components may also be interfaced with controller 30, as will be appreciated by those of ordinary skill having the benefit of the instant disclosure. For example, one or more tubular spray element (TSE) drives 56 and/or one or more tubular spray element (TSE) valves 58 may be provided in some embodiments to discretely control one or more tubular spray elements disposed in dishwasher 10, as will be discussed in greater detail below.

It will be appreciated that each tubular spray element drive 56 may also provide feedback to controller 30 in some embodiments, e.g., a current position and/or speed, although in other embodiments a separate position sensor may be used. In addition, as will become more apparent below, flow regulation to a tubular spray element may be performed without the use of a separately-controlled tubular spray element valve 58 in some embodiments, e.g., where rotation of a tubular spray element by a tubular spray element drive is used to actuate a mechanical valve.

Moreover, in some embodiments, at least a portion of controller 30 may be implemented externally from a dishwasher, e.g., within a mobile device, a cloud computing environment, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein. Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher illustrated in FIGS. 1-2 will be apparent to one of ordinary skill in the art, as will become apparent from the description below. Therefore, the invention is not limited to the specific implementations discussed herein.

Tubular Spray Elements

Figure 3:
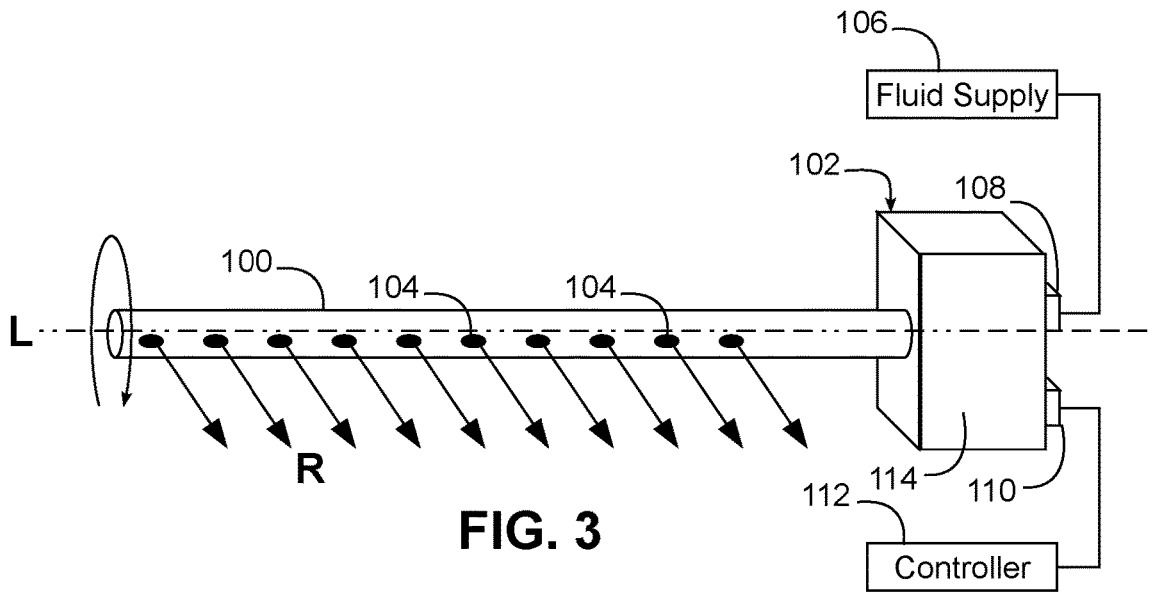
FIG. 3 is a side perspective view of a tubular spray element and tubular spray element drive from the dishwasher of FIG. 1.

Now turning to FIG. 3, in some embodiments, a dishwasher may include one or more discretely directable tubular spray elements, e.g., tubular spray element 100 coupled to a tubular spray element drive 102. Tubular spray element 100 may be configured as a tube or other elongated body disposed in a wash tub and being rotatable about a longitudinal axis L. In addition, tubular spray element 100 is generally hollow or at least includes one or more internal fluid passages that are in fluid communication with one or more apertures 104 extending through an exterior surface thereof. Each aperture 104 may function to direct a spray of fluid into the wash tub, and each aperture may be configured in various manners to provide various types of spray patterns, e.g., streams, fan sprays, concentrated sprays, etc. Apertures 104 may also in some instances be configured as fluidic nozzles providing oscillating spray patterns.

Moreover, as illustrated in FIG. 3, apertures 104 may all be positioned to direct fluid along a same radial direction from axis L, thereby focusing all fluid spray in generally the same radial direction represented by arrows R. In other embodiments, however, apertures may be arranged differently about the exterior surface of a tubular spray element, e.g., to provide spray from two, three or more radial directions, to distribute a spray over one or more arcs about the circumference of the tubular spray element, etc.

Tubular spray element 100 is in fluid communication with a fluid supply 106, e.g., through a port 108 of tubular spray element drive 102, to direct fluid from the fluid supply into the wash tub through the one or more apertures 104. Tubular spray element drive 102 is coupled to tubular spray element 100 and is configured to discretely direct the tubular spray element 100 to each of a plurality of rotational positions about longitudinal axis L. By "discretely directing," what is meant is that tubular spray element drive 102 is capable of rotating tubular spray element 100 generally to a controlled rotational angle (or at least within a range of rotational angles) about longitudinal axis L. Thus, rather than uncontrollably rotating tubular spray element 100 or uncontrollably oscillating the tubular spray element between two fixed rotational positions, tubular spray element drive 102 is capable of intelligently focusing the spray from tubular spray element 100 between multiple rotational positions. It will also be appreciated that rotating a tubular spray element to a controlled rotational angle may refer to an absolute rotational angle (e.g., about 10 degrees from a home position) or may refer to a relative rotational angle (e.g., about 10 degrees from the current position).

Tubular spray element drive 102 is also illustrated with an electrical connection 110 for coupling to a controller 112, and a housing 114 is illustrated for housing various components in tubular spray element drive 102 that will be discussed in greater detail below. In the illustrated embodiment, tubular spray element drive 102 is configured as a base that supports, through a rotary coupling, an end of the tubular spray element and effectively places the tubular spray element in fluid communication with port 108.

By having an intelligent control provided by tubular spray element drive 102 and/or controller 112, spray patterns and cycle parameters may be increased and optimized for different situations. For instance, tubular spray elements near the center of a wash tub may be configured to rotate 360 degrees, while tubular spray elements located near wash tub walls may be limited to about 180 degrees of rotation to avoid spraying directly onto any of the walls of the wash tub, which can be a significant source of noise in a dishwasher. In another instance, it may be desirable to direct or focus a tubular spray element to a fixed rotational position or over a small range of rotational positions (e.g., about 5-10 degrees) to provide concentrated spray of liquid, steam and/or air, e.g., for cleaning silverware or baked on debris in a pan. In addition, in some instances the rotational velocity of a tubular spray element could be varied throughout rotation to provide longer durations in certain ranges of rotational positions and thus provide more concentrated washing in particular areas of a wash tub, while still maintaining rotation through 360 degrees. Control over a tubular spray element may include control over rotational position, speed or rate of rotation and/or direction of rotation in different embodiments of the invention.

Figure 4:
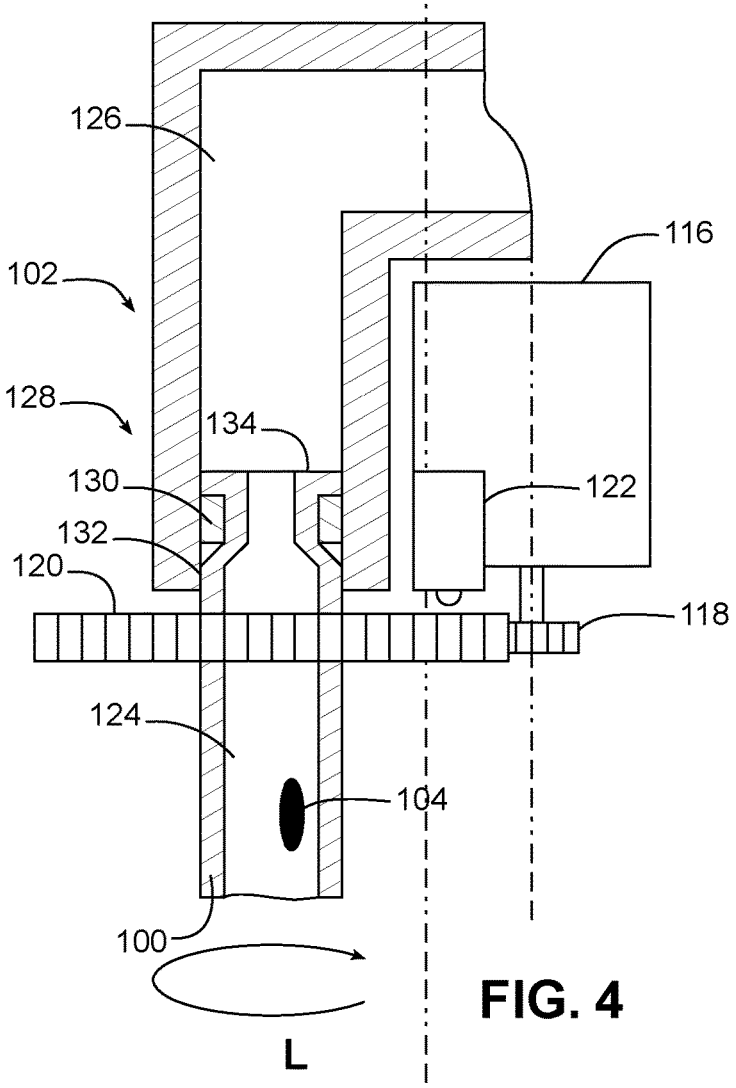
FIG. 4 is a partial cross-sectional view of the tubular spray element and tubular spray element drive of FIG. 3.

FIG. 4 illustrates one example implementation of tubular spray element 100 and tubular spray element drive 102 in greater detail, with housing 114 omitted for clarity. In this implementation, tubular spray element drive 102 includes an electric motor 116, which may be an alternating current (AC) or direct current (DC) motor, e.g., a brushless DC motor, a stepper motor, etc., which is mechanically coupled to tubular spray element 100 through a gearbox including a pair of gears 118, 120 respectively coupled to motor 116 and tubular spray element 100. Other manners of mechanically coupling motor 116 to tubular spray element 100 may be used in other embodiments, e.g., different numbers and/or types of gears, belt and pully drives, magnetic drives, hydraulic drives, linkages, friction, etc.

In addition, an optional position sensor 122 may be disposed in tubular spray element drive 102 to determine a rotational position of tubular spray element 100 about axis L. Position sensor 122 may be an encoder or hall sensor in some embodiments, or may be implemented in other manners, e.g., integrated into a stepper motor, whereby the rotational position of the motor is used to determine the rotational position of the tubular spray element. Position sensor 122 may also sense only limited rotational positions about axis L (e.g., a home position, 30 or 45 degree increments, etc.). Further, in some embodiments, rotational position may be controlled using time and programming logic, e.g., relative to a home position, and in some instances without feedback from a motor or position sensor. Position sensor 122 may also be external to tubular spray element drive 102 in some embodiments.

An internal passage 124 in tubular spray element 100 is in fluid communication with an internal passage 126 leading to port 108 (not shown in FIG. 4) in tubular spray element drive 102 through a rotary coupling 128. In one example implementation, coupling 128 is formed by a bearing 130 mounted in passageway 126, with one or more deformable tabs 134 disposed at the end of tubular spray element 100 to secure tubular spray element 100 to tubular spray element drive 102. A seal 132, e.g., a lip seal, may also be formed between tubular spray element 100 and tubular spray element drive 102. Other manners of rotatably coupling the tubular spray element while providing fluid flow may be used in other embodiments.

Figure 5:
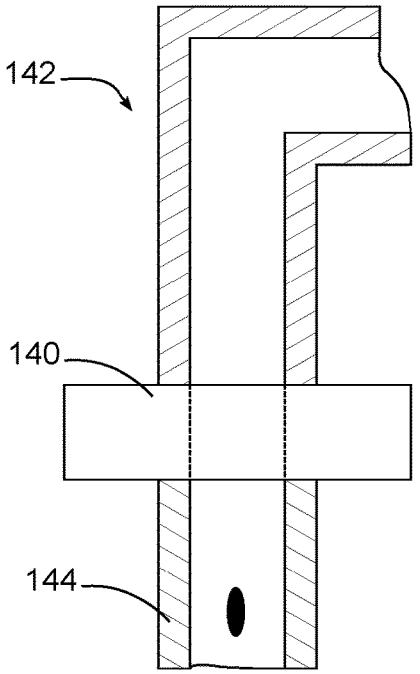
FIG. 5 is a partial cross-sectional view of another tubular spray element and tubular spray element drive consistent with some embodiments of the invention, and including a valve for restricting flow to the tubular spray element.

Turning to FIG. 5, it also may be desirable in some embodiments to incorporate a valve 140 into a tubular spray element drive 142 to regulate the fluid flow to a tubular spray element 144 (other elements of drive 142 have been omitted from FIG. 5 for clarity). Valve 140 may be an on/off valve in some embodiments or may be a variable valve to control flow rate in other embodiments. In still other embodiments, a valve may be external to or otherwise separate from a tubular spray element drive, and may either be dedicated to the tubular spray element or used to control multiple tubular spray elements. Valve 140 may be integrated with or otherwise proximate a rotary coupling between tubular spray element 144 and tubular spray element drive 142. By regulating fluid flow to tubular spray elements, e.g., by selectively shutting off tubular spray elements, water can be conserved and/or high-pressure zones can be created by pushing all of the hydraulic power through fewer numbers of tubular spray elements.

In some embodiments, valve 140 may be actuated independent of rotation of tubular spray element 144, e.g., using an iris valve, butterfly valve, gate valve, plunger valve, piston valve, valve with a rotatable disc, ball valve, etc., and actuated by a solenoid, motor or other separate mechanism from the mechanism that rotates tubular spray element 144. In other embodiments, however, valve 140 may be actuated through rotation of tubular spray element 144. In some embodiments, for example, rotation of tubular spray element 144 to a predetermined rotational position may close valve 140, e.g., where valve 140 includes an arcuate channel that permits fluid flow over only a range of rotational positions. In other embodiments, a valve may be actuated through over-rotation of a tubular spray element, or through counter rotation of a tubular spray element. Further, in some embodiments, a valve may be variable, e.g., configured as an iris valve, to regulate fluid flow to the tubular spray element, and may be independently actuated from rotation of a tubular spray element in some embodiments (e.g., via a solenoid or motor), or may be actuated through rotation of a tubular spray element, e.g., through rotation to a predetermined position, an over-rotation, or a counter-rotation, using appropriate mechanical linkages. Other variations will be appreciated by those of ordinary skill having the benefit of the instant disclosure.

Figure 6:
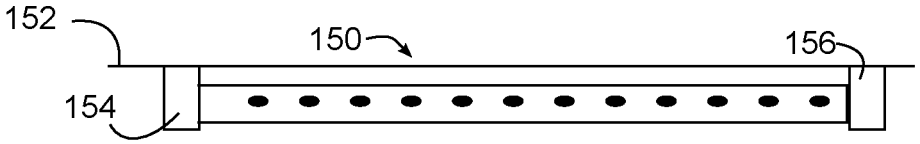
FIG. 6 is a functional top plan view of an example implementation of a wall-mounted tubular spray element and tubular spray element drive consistent with some embodiments of the invention.
Figure 7:
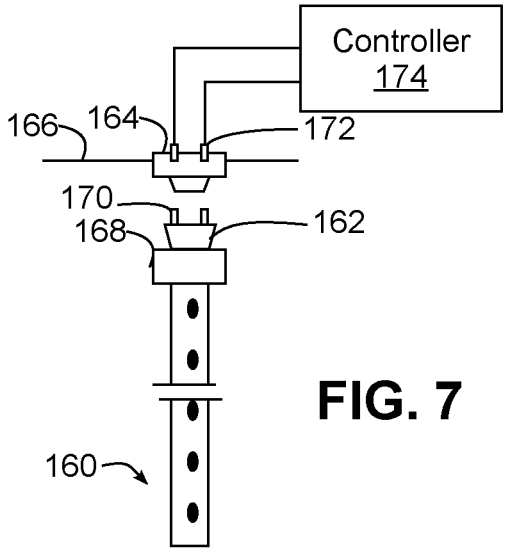
FIG. 7 is a functional top plan view of an example implementation of a rack-mounted tubular spray element and tubular spray element drive consistent with some embodiments of the invention.
Figure 8:
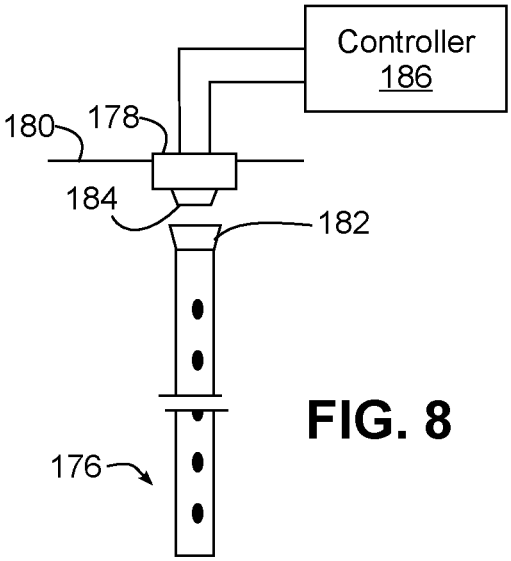
FIG. 8 is a functional top plan view of another example implementation of a rack-mounted tubular spray element and tubular spray element drive consistent with some embodiments of the invention.

Now turning to FIGS. 6-8, tubular spray elements may be mounted within a wash tub in various manners in different embodiments. As illustrated by FIGS. 1 and 3 (discussed above), a tubular spray element in some embodiments may be mounted to a wall (e.g., a side wall, a back wall, a top wall, a bottom wall, or a door) of a wash tub, and may be oriented in various directions, e.g., horizontally, vertically, front-to-back, side-to-side, or at an angle. It will also be appreciated that a tubular spray element drive may be disposed within a wash tub, e.g., mounted on wall of the wash tub or on a rack or other supporting structure, or alternatively some or all of the tubular spray element drive may be disposed external from a wash tub, e.g., such that a portion of the tubular spray element drive or the tubular spray element projects through an aperture in the wash tub. Alternatively, a magnetic drive could be used to drive a tubular spray element in the wash tub using an externally-mounted tubular spray element drive.

Moreover, as illustrated by tubular spray element 150 of FIG. 6, rather than being mounted in a cantilevered fashion as is the case with tubular spray element 100 of FIG. 3, a tubular spray element may also be mounted on a wall 152 of a wash tub and supported at both ends by hubs 154, 156, one or both of which may include the components of the tubular spray element drive. In this regard, the tubular spray element 150 runs generally parallel to wall 152 rather than running generally perpendicular thereto, as is the case with tubular spray element 100 of FIG. 3.

In still other embodiments, a tubular spray element may be rack-mounted. FIG. 7, for example, illustrates a tubular spray element 160 mountable on rack (not shown) and dockable via a dock 162 to a docking port 164 on a wall 166 of a wash tub. In this embodiment, a tubular spray element drive 168 is also rack-mounted, and as such, in addition to a fluid coupling between dock 162 and docking port 164, a plurality of cooperative contacts 170, 172 are provided on dock 162 and docking port 164 to provide power to tubular spray element drive 168 as well as electrical communication with a controller 174.

As an alternative, and as illustrated in FIG. 8, a tubular spray element 176 may be rack-mounted, but separate from a tubular spray element drive 178 that is not rack-mounted, but is instead mounted to a wall 180 of a wash tub. A dock 182 and docking port 184 provide fluid communication with tubular spray element 176, along with a capability to rotate tubular spray element 176 about its longitudinal axis under the control of tubular spray element drive 178. Control over tubular spray element drive 178 is provided by a controller 186. In some instances, tubular spray element drive 178 may include a rotatable and keyed channel into which an end of a tubular spray element may be received.

Figure 9:
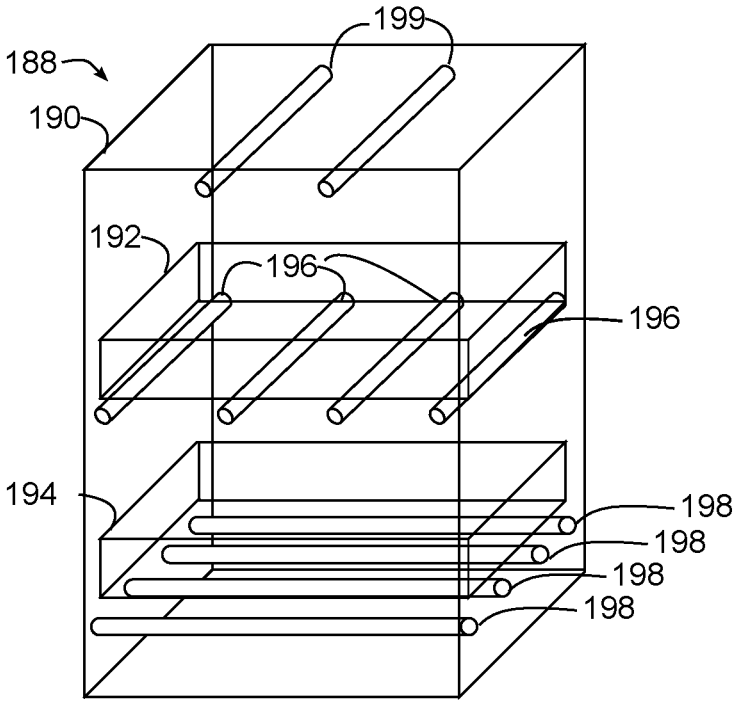
FIG. 9 is a functional perspective view of a dishwasher incorporating multiple tubular spray elements and consistent with some embodiments of the invention.

FIG. 9 next illustrates a dishwasher 188 including a wash tub 190 and upper and lower racks 192, 194, and with a number of tubular spray elements 196, 198, 199 distributed throughout the wash tub 190 for circulating a wash fluid through the dishwasher. Tubular spray elements 196 may be rack-mounted, supported on the underside of upper rack 192, and extending back-to-front within wash tub 190. Tubular spray elements 196 may also dock with back wall-mounted tubular spray element drives (not shown in FIG. 9), e.g., as discussed above in connection with FIG. 8. In addition, tubular spray elements 196 may be rotatably supported at one or more points along their respective longitudinal axes by couplings (not shown) suspended from upper rack 192. Tubular spray elements 196 may therefore spray upwardly into upper rack 192 and/or downwardly onto lower rack 194, and in some embodiments, may be used to focus wash fluid onto a silverware basket or other region of either rack to provide for concentrated washing. Tubular spray elements 198 may be wall-mounted beneath lower rack 194, and may be supported at both ends on the side walls of wash tub 190 to extend in a side-to-side fashion, and generally transverse to tubular spray elements 196. Each tubular spray element 196, 198 may have a separate tubular spray element drive in some embodiments, while in other embodiments some or all of the tubular spray elements 196, 198 may be mechanically linked and driven by common tubular spray element drives.

In some embodiments, tubular spray elements 196, 198 by themselves may provide sufficient washing action and coverage. In other embodiments, however, additional tubular spray elements, e.g., tubular spray elements 199 supported above upper rack 192 on one or both of the top and back walls of wash tub 190, may also be used. In addition, in some embodiments, additional spray arms and/or other sprayers may be used. It will also be appreciated that while 10 tubular spray elements are illustrated in FIG. 9, greater or fewer numbers of tubular spray elements may be used in other embodiments.

It will also be appreciated that in some embodiments, multiple tubular spray elements may be driven by the same tubular spray element drive, e.g., using geared arrangements, belt drives, or other mechanical couplings. Further, tubular spray elements may also be movable in various directions in addition to rotating about their longitudinal axes, e.g., to move transversely to a longitudinally axis, to rotate about an axis of rotation that is transverse to a longitudinal axis, etc. In addition, deflectors may be used in combination with tubular spray elements in some embodiments to further the spread of fluid and/or prevent fluid from hitting tub walls. In some embodiments, deflectors may be integrated into a rack, while in other embodiments, deflectors may be mounted to a wall of the wash tub. In addition, deflectors may also be movable in some embodiments, e.g., to redirect fluid between multiple directions. Moreover, while in some embodiments tubular spray elements may be used solely to spray wash fluid, in other embodiments tubular spray elements may be used to spray pressurized air at utensils during a drying operation of a wash cycle, e.g., to blow off water that pools on cups and dishes after rinsing is complete. In some instances, different tubular spray elements may be used to spray wash fluid and spray pressurized air, while in other instances the same tubular spray elements may be used to alternately or concurrently spray wash liquid and pressurized air.

Tubular Spray Element with Metal Tube and Molded Polymer Support Member

In some embodiments, for cost and/or simplicity, it may be desirable to utilize a prefabricated elongated metal tube in a tubular spray element. However, due to the need to provide support for the tubular spray element, as well as a way to rotate the tubular spray element and supply fluid thereto, it may also be desirable to include components such as gears, valves, supports, etc. that are more suited for construction out of molded and/or polymer materials. Joining molded polymer parts to prefabricated elongated metal tubes, however, desirably minimizes the number of processes performed on the elongated metal tubes, which would otherwise defeat the purpose of using such tubes. In embodiments consistent with the invention, as described below, a retaining mechanism incorporating a retaining tab supported on a molded polymer support member through a living hinge may be used to engage with a mounting aperture on a sidewall of an elongated metal tube to provide a suitable mechanism for fastening the support member to the elongated metal tube, and to do so in an economical, simple, and easily-manufactured manner.

Figure 10:
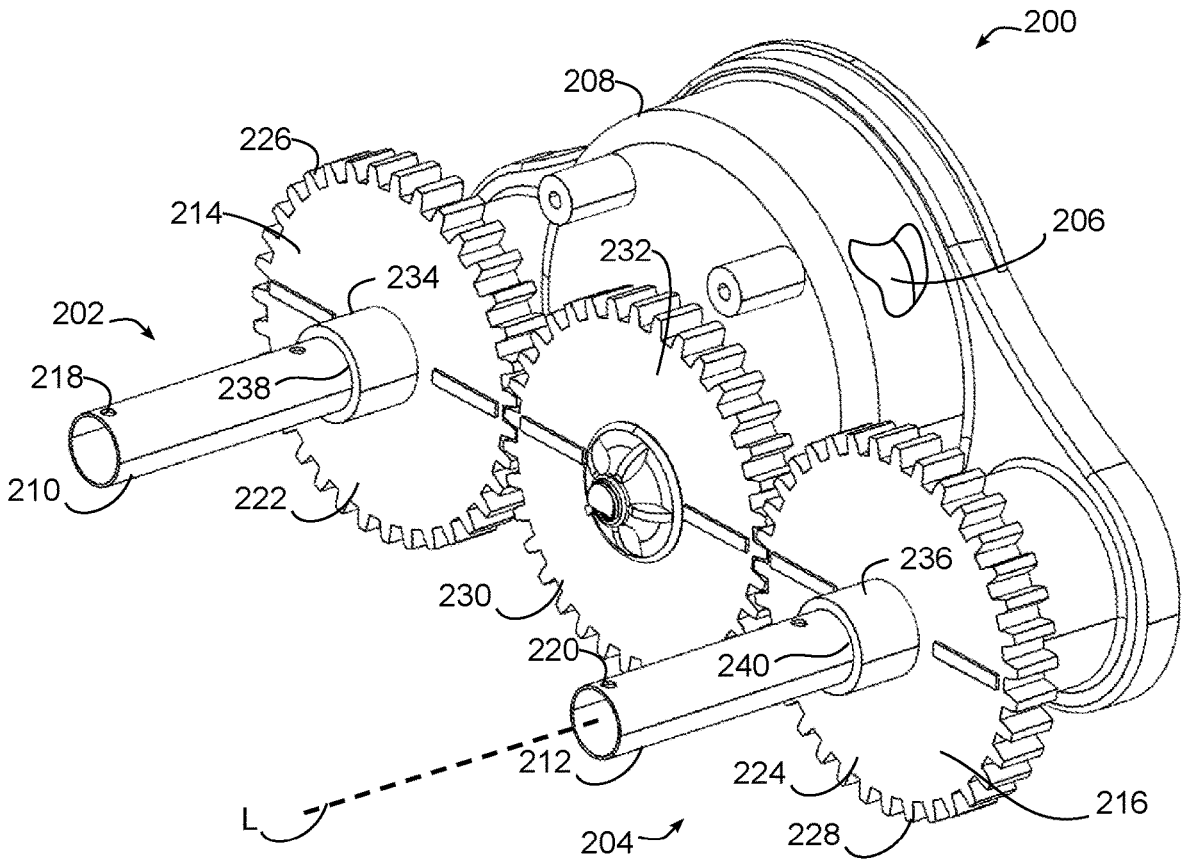
FIG. 10 is a perspective view of an example implementation of wall-mounted tubular spray element spraying system consistent with some embodiments of the invention.

Now turning to FIGS. 10-16, and initially with reference to FIG. 10, an example dishwasher spray assembly 200 is illustrated, which includes a pair of tubular spray elements 202, 204 driven by a motor 206 disposed in a manifold 208, and suitable for mounting tubular spray elements 202, 204 on a wall of a wash tub as well as supplying fluid thereto. Each tubular spray element 202, 204 in the illustrated embodiment includes an elongated metal tube 210, 212 formed, for example, of stainless steel or another suitable material, and supported by a molded polymer support member 214, 216 suitable for supporting the respective metal tube 210, 212 in a cantilevered fashion.

Each elongated metal tube 210, 212 includes a plurality of apertures 218, 220 suitable for directing wash fluid into the wash tub. Each tubular spray element 202, 204 moreover is rotatable about its longitudinal axis, e.g., axis L for tubular spray element 204. In order to rotate each tubular spray element, the support member 214, 216 thereof includes a gear 222, 224 including a plurality of teeth 226, 228 that generally project radially from the longitudinal axis of the respective tubular spray element 202, 204 and mate with cooperative teeth 230 on a drive gear 232 driven by motor 206.

Figure 11:
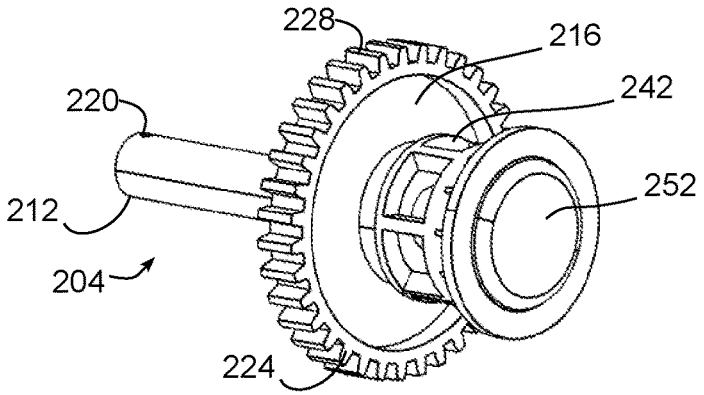
FIG. 11 is a perspective view of one of the tubular spray elements illustrated in FIG. 10.
Figure 12:
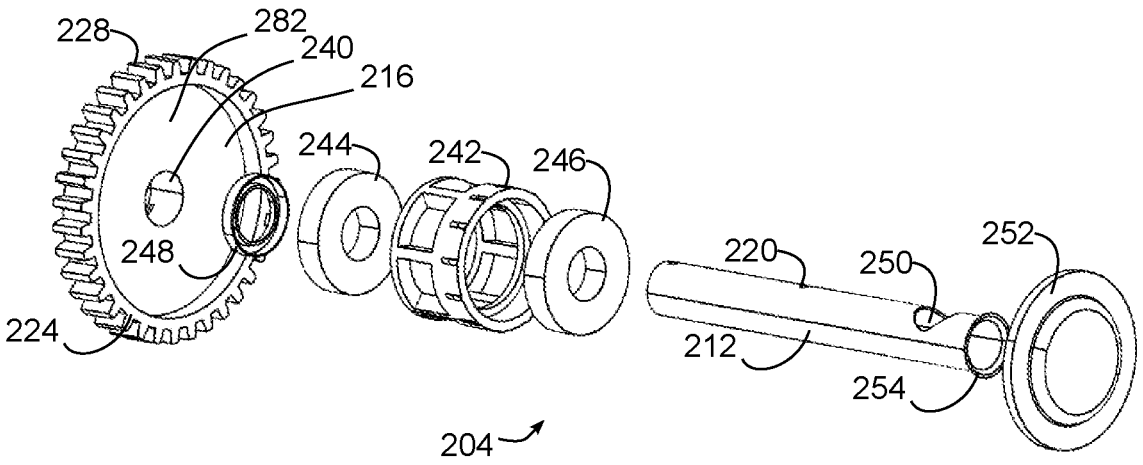
FIG. 12 is an exploded perspective view of the tubular spray element of FIG. 11.

Each support member 214, 216 also includes a tubular portion 234, 236 that includes a sleeve or channel 238, 240 configured to receive the elongated metal tube 210, 212, and that generally projects axially from gear 222, 224 along the longitudinal axis of the respective tubular spray element 202, 204. In addition, as illustrated in FIGS. 11-12, for tubular spray element 204 (and tubular spray element 202 may be configured similarly), the tubular spray element may be rotatably supported within a valve body 242 by a pair of bearings 244, 246 and a radial lip seal 248 such that an inlet 250 on elongated metal tube 212 may rotate within valve body 242, and a cap or gasket 252 may seal a supported end 254 of elongated metal tube 212, which may be widened or flanged in some embodiments as illustrated in FIG. 11. In some embodiments, valve body 242 may be configured to seal inlet 250 at a predetermined rotational position to effectively shut off the supply of fluid to tubular spray element 204, although the invention is not so limited.

Figure 13:
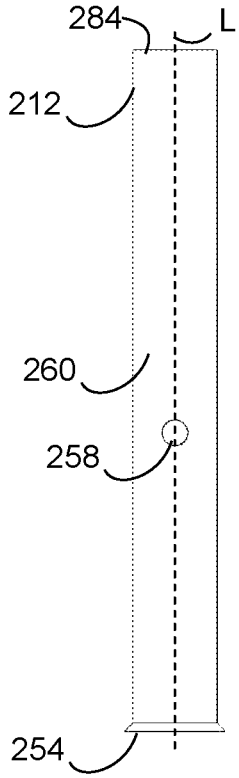
FIG. 13 is an elevational view of the elongated metal tube of the tubular spray element of FIGS. 11-12.
Figure 14:
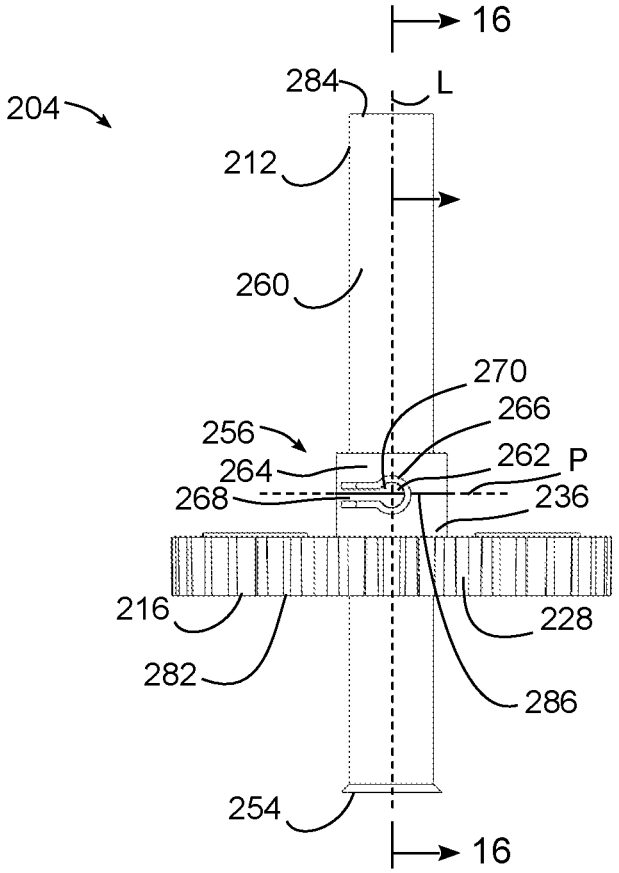
FIG. 14 is an elevational view of the elongated metal tube and support member of the tubular spray element of FIGS. 11-12.

As illustrated in FIGS. 13-14, a retaining mechanism 256, including a mounting aperture 258 disposed on a sidewall 260 of elongated metal tube 212 and a retaining tab 262 disposed on tubular portion 236 of support member 216, may be used to secure or couple elongated metal tube 212 with support member 216 and thereby restrict relative movement between elongated metal tube 212 and support member 216 both about and along longitudinal axis L. Retaining tab 262 in particular projects inwardly into sleeve 240 in a substantially radial direction relative to longitudinal axis L.

Retaining tab 262 in the illustrated embodiment is integrally molded into a sidewall 264 of tubular portion 236 and defined by a continuous slot 266 that further defines a living hinge 268 that is integrally molded into support member 216 and effectively couples retaining tab 262 to support member 216. Retaining tab 262 may include a bulbous head 270 that may be circular in shape or otherwise have a shape and size suitable for projecting into mounting aperture 258 when elongated metal tube 212 and support member 216 are appropriately aligned. Living hinge 268 in contrast may be configured as a relatively narrow strip having a smaller width than that of bulbous head 270 to provide a desired degree of flexibility. The size and configuration of each of living hinge 268 and bulbous head 270 of retaining tab 262, however, may vary in other embodiments.

In the illustrated embodiment, living hinge 268 extends along and flexes within a plane P (FIG. 14) that is substantially transverse to longitudinal axis L. In addition, in some embodiments, it may be desirable to orient living hinge 268 and retaining tab 262 such that the retaining tab trails the living hinge in a primary direction of rotation of the tubular spray element, e.g., a generally clockwise direction from the perspective of FIG. 10. In other embodiments, however, living hinge 268 may extend along and flex within different planes, e.g., along longitudinal axis L, so the invention is not limited to the particular configuration illustrated herein.

Figure 15:
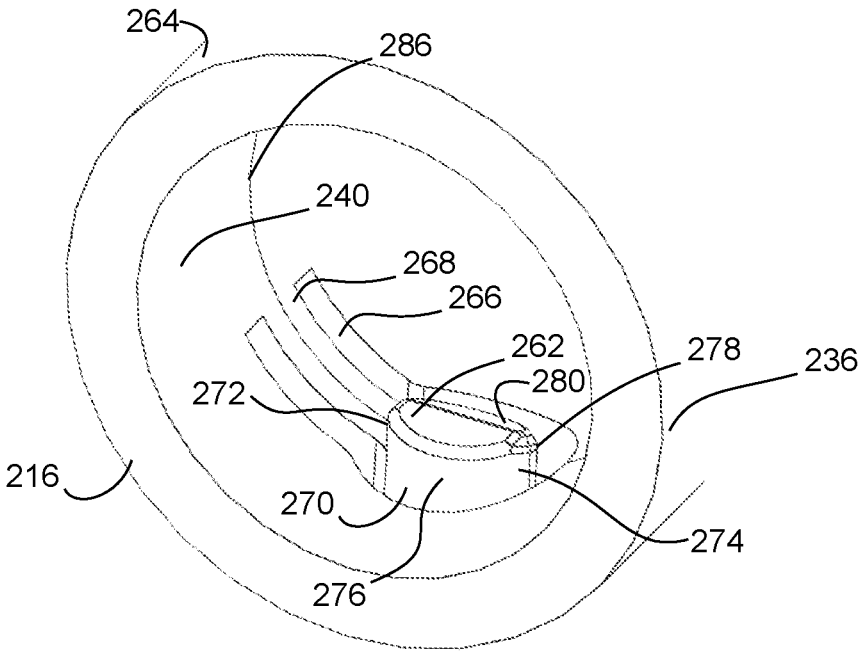
FIG. 15 is an enlarged perspective view of a tubular portion of the support member of the tubular spray element of FIGS. 11-12 and 14.
Figure 16:
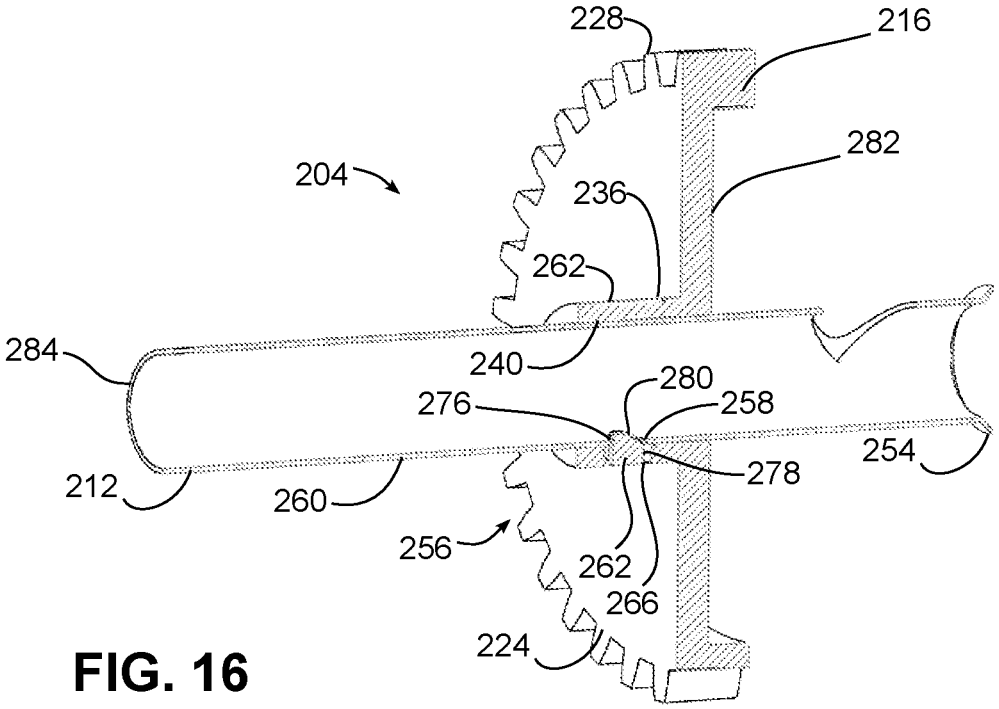
FIG. 16 is a cross-sectional view of the tubular spray element of FIGS. 11-12 and 14, and taken along lines 16-16 of FIG. 14.

In the illustrated embodiment, and as illustrated in FIGS. 15 and 16, retaining tab 262 may include a plurality of sidewalls 272, 274, 276 and 278 that are configured to engage the edge of mounting aperture 258 when retaining tab 262 is retained therein and thereby restrict relative movement between elongated metal tube 212 and support member 216. Sidewalls 272 and 274 generally oppose one another and restrict relative rotation between elongated metal tube 212 and support member 216 about longitudinal axis L, while sidewalls 276, 278 are each intermediate sidewalls 272 and 274 and generally oppose one another restrict relative movement in an axial direction along longitudinal axis L. With mounting aperture 258 being circular in shape as shown in the illustrated embodiment, sidewalls 272-278 may form a substantially continuous cylindrical surface having a diameter substantially matching that of mounting aperture 258. For other mounting aperture shapes, however, sidewalls 272-278 may be differently configured, e.g., forming distinct planar and/or curved surfaces.

In addition, in the illustrated embodiment it may be desirable to incorporate an inclined ramp 280 on retaining tab 262 to facilitate assembly of elongated metal tube 212 and support member 216. In particular, inclined ramp 280 may be oriented and angled such that when elongated metal tube 212 is inserted into sleeve 240 of support member 216 from a backside 282 thereof, a leading edge 284 of elongated metal tube 212 will engage with inclined ramp 280 to flex living hinge 268 and thereby deflect retaining tab 262 until retaining tab 262 is aligned with mounting aperture 258, at which point the bias of living hinge 268 will urge retaining tab 262 into mounting aperture 258 and thereby join elongated metal tube 212 and support member 216 in proper alignment.

While support member 216 may be molded using a number of different technologies in other embodiments, in the illustrated embodiment support member 216 is injection molded using a single cavity/core mold with a divided draft, with both sides of living hinge 268 and retaining tab 262 formed on opposite drafts, e.g., as represented by part line 286 in FIGS. 14 and 15, which bisects each of living hinge 268 and retaining tab 262. Doing so enables a single action to be used to form the continuous slot 266 around living hinge 268 and retaining tab 262.

There herein-described retaining mechanism therefore provides a relatively simple, reliable, and inexpensive method of attachment suitable for use with prefabricated elongated metal tubes, and one that is generally more suitable for large scale manufacturing than alternative technologies such as set screws, knurling, press-fitting, etc. It will be appreciated that a wide variety of alternative configurations may be used in other embodiments, including the use of multiple retaining tabs/mounting apertures, as well as different living hinge orientations and/or retaining tab configurations. In addition, rather than projecting radially inwardly into a sleeve as illustrated herein, a retaining tab in other embodiments may project in different orientations and directions to engage with a mounting aperture in an elongated metal tube, including, for example, radially outwardly (e.g., where the elongated metal tube slides over an outwardly-facing sleeve rather than an inwardly-facing sleeve), or in other directions that will be appreciated by those of ordinary skill having the benefit of the instant disclosure.

Other modifications may be made to the illustrated embodiments without departing from the spirit and scope of the invention. Therefore, the invention lies in the claims hereinafter appended.

What is claimed is:

1. A dishwasher, comprising:

a wash tub;

a fluid supply configured to supply a wash fluid; and a tubular spray element disposed within the wash tub and being rotatable about a longitudinal axis thereof, the tubular spray element including a plurality of apertures in fluid communication with the fluid supply to direct wash fluid into the wash tub, the tubular spray element further including:

an elongated metal tube including a supported end through which wash fluid is received from the fluid supply, a sidewall in which the plurality of apertures is disposed, and a mounting aperture disposed in the sidewall proximate the supported end of the elongated metal tube;

a support member formed of a molded polymer material and including a sleeve configured to receive the supported end of the elongated metal tube; and a retaining tab molded into the support member and projecting substantially radially within the sleeve to engage with the mounting aperture of the elongated metal tube and thereby restrict relative movement between the elongated metal tube and the support member both about and along the longitudinal axis of the tubular spray element, wherein the retaining tab is coupled to the support member through an integrally molded living hinge that extends along and flexes within a plane that is substantially transverse to the longitudinal axis.

2. The dishwasher of claim 1, wherein the support member further includes a gear molded thereon.

3. The dishwasher of claim 2, wherein the gear includes a plurality of teeth projecting radially from the longitudinal axis of the tubular spray element.

4. The dishwasher of claim 2, wherein the sleeve is disposed within a tubular portion of the support member that projects axially from the gear along the longitudinal axis of the tubular spray element.

5. The dishwasher of claim 1, wherein the retaining tab includes a bulbous head and the living hinge has a width that is less than that of the bulbous head.

6. The dishwasher of claim 1, wherein the sleeve is disposed in a tubular portion of the support member that projects axially along the longitudinal axis of the tubular spray element, wherein the retaining tab projects inwardly into the sleeve in a substantially radial direction relative to the longitudinal axis, and wherein the retaining tab and at least a portion of the living hinge are separated from a sidewall of the tubular portion by a continuous slot formed in the sidewall of the tubular portion.

7. The dishwasher of claim 1, wherein the retaining tab trails the living hinge in a direction of rotation of the tubular spray element.

8. The dishwasher of claim 1, wherein the support member has an injection molding part line extending along the plane such that the retaining tab and the living hinge are substantially bisected by the injection molding part line.

9. The dishwasher of claim 8, wherein the retaining tab and the living hinge are formed using a single action during injection molding.

10. The dishwasher of claim 1, wherein the retaining tab includes opposing first and second sidewalls that engage with the mounting aperture when the retaining tab is received within the mounting aperture to restrict relative rotational movement between the elongated metal tube and the support member about the longitudinal axis.

11. The dishwasher of claim 10, wherein the retaining tab further includes a third sidewall disposed intermediate the first and second sidewalls and configured to engage with the mounting aperture when the retaining tab is received within the mounting aperture to restrict relative movement between the elongated metal tube and the support member along the longitudinal axis.

12. The dishwasher of claim 11, wherein the retaining tab further includes a fourth sidewall disposed intermediate the first and second sidewalls and opposing the third sidewall, the fourth sidewall configured to engage with the mounting aperture when the retaining tab is received within the mounting aperture to further restrict relative movement between the elongated metal tube and the support member along the longitudinal axis.

13. The dishwasher of claim 11, wherein the mounting aperture is substantially circular, and wherein the first, second and third sidewalls of the retaining tab form at least a portion of a cylindrical surface having a diameter substantially matching that of the mounting aperture.

14. The dishwasher of claim 11, wherein the retaining tab further includes an inclined ramp configured to engage with an edge of the elongated metal tube when inserting the elongated metal tube into the sleeve of the support member during assembly to flex the living hinge and thereby deflect the retaining tab until the retaining tab is aligned with the mounting aperture.

15. The dishwasher of claim 14, wherein the inclined ramp faces a backside of the support member such that the elongated metal tube is inserted through the backside of the support member during assembly.

16. A dishwasher tubular spray element, comprising:

an elongated metal tube being rotatable about a longitudinal axis thereof and including a supported end through which wash fluid is received from a fluid supply, a plurality of apertures formed in a sidewall thereof and configured to direct wash fluid supplied through the supported end into a wash tub, and a mounting aperture disposed in the sidewall proximate the supported end of the elongated metal tube;

a support member formed of a molded polymer material and including a sleeve configured to receive the supported end of the elongated metal tube; and a retaining tab molded into the support member and projecting substantially radially within the sleeve to engage with the mounting aperture of the elongated metal tube and thereby restrict relative movement between the elongated metal tube and the support member both about and along the longitudinal axis;

wherein the retaining tab is coupled to the support member through an integrally molded living hinge, and wherein the living hinge extends along and flexes within a plane that is substantially transverse to the longitudinal axis.

17. The dishwasher tubular spray element of claim 16, wherein the sleeve is disposed in a tubular portion of the support member that projects axially along the longitudinal axis of the tubular spray element, wherein the retaining tab projects inwardly into the sleeve in a substantially radial direction relative to the longitudinal axis, and wherein the retaining tab and at least a portion of the living hinge are separated from a sidewall of the tubular portion by a continuous slot formed in the sidewall of the tubular portion.

18. The dishwasher tubular spray element of claim 17, wherein the support member has an injection molding part line extending along the plane such that the retaining tab and the living hinge are substantially bisected by the injection molding part line, and wherein the retaining tab includes:

opposing first and second sidewalls that engage with the mounting aperture when the retaining tab is received within the mounting aperture to restrict relative rotational movement between the elongated metal tube and the support member about the longitudinal axis;

a third sidewall disposed intermediate the first and second sidewalls and configured to engage with the mounting aperture when the retaining tab is received within the mounting aperture to restrict relative movement between the elongated metal tube and the support member along the longitudinal axis; and an inclined ramp configured to engage with an edge of the elongated metal tube when inserting the elongated metal tube into the sleeve of the support member during assembly to flex the living hinge and thereby deflect the retaining tab until the retaining tab is aligned with the mounting aperture.

19. A dishwasher, comprising:

a wash tub;

a fluid supply configured to supply a wash fluid; and a tubular spray element disposed within the wash tub and being rotatable about a longitudinal axis thereof, the tubular spray element including a plurality of apertures in fluid communication with the fluid supply to direct wash fluid into the wash tub, the tubular spray element further including:

an elongated metal tube including a widened supported end through which wash fluid is received from the fluid supply, a sidewall in which the plurality of apertures are disposed, and a mounting aperture disposed in the sidewall proximate the supported end of the elongated metal tube;

a support member formed of a molded polymer material and including a sleeve configured to receive the supported end of the elongated metal tube, the sleeve having a diameter that is smaller than that of the widened supported end of the elongated metal tube; and a retaining tab molded into the support member and projecting substantially radially within the sleeve to engage with the mounting aperture of the elongated metal tube and thereby restrict relative movement between the elongated metal tube and the support member both about and along the longitudinal axis of the tubular spray element, the retaining tab including an inclined ramp configured to engage with an edge of the elongated metal tube when inserting the elongated metal tube into the sleeve of the support member during assembly to deflect the retaining tab until the retaining tab is aligned with the mounting aperture, wherein the inclined ramp faces a backside of the support member such that the elongated metal tube is inserted through the backside of the support member during assembly.

* * * * *